United States Patent [19]

Kroll et al.

[11] 4,292,921

[45] Oct. 6, 1981

[54] ELECTROGRAPHIC DEVELOPMENT APPARATUS

[75] Inventors: Arthur S. Kroll, Spencerport; Frank A. Shuster, Rochester, both of N.Y.

[73] Assignee: Eastman Kodak Company, Rochester, N.Y.

[21] Appl. No.: 27,115

[22] Filed: Apr. 4, 1979

[51] Int. Cl.[3] ..... G03G 15/06

[52] U.S. Cl. ..... 118/648; 118/651; 118/655; 118/657; 118/658

[58] Field of Search ..... 118/656, 657, 658, 661, 118/648, 651, 655

[56] References Cited

U.S. PATENT DOCUMENTS

| | | | |
|---|---|---|---|
| 3,643,629 | 2/1972 | Kangas et al. | 118/637 |
| 3,664,857 | 5/1972 | Miller | 118/637 |
| 4,131,357 | 12/1978 | Forbes | 118/657 |

FOREIGN PATENT DOCUMENTS 964 3/1979 European Pat. Off.

*Primary Examiner*—Bernard D. Pianalto
*Attorney, Agent, or Firm*—John D. Husser

[57] ABSTRACT

Improved electrographic development apparatus and procedure for use with partially-conductive developer employs transport of the developer through a first development zone in a direction generally countercurrent to a moving image member and through a second development zone in a direction generally cocurrent to the moving image member. The extent of image development within each such zone is controlled by the rate of developer transport and/or the magnitude of developer bias, so that overall development of the different portions of large solid image areas (particularly leading and trailing portions of such areas) is equalized.

17 Claims, 7 Drawing Figures

ELECTROGRAPHIC DEVELOPMENT APPARATUS

BACKGROUND OF THE INVENTION

1. Field of the Invention

The present invention relates to electrographic development apparatus and process which provide enhanced development with partially-conductive developer.

2. Description of the Prior Art

In the art of electrographic reproduction, e.g., electrophotographic copying, one direction of advance is toward the production of higher quality copies at faster copying rates, e.g., to serve the intermediate run duplication market which presently requires offset printing techniques. Rapid, high quality electrographic development, i.e., the application of toner to a latent electrostatic image, has presented particular problems to efforts in this direction. This is particularly true with respect to development of large solid or large continuous tone areas of the image (i.e., image areas which bear a generally uniform charge corresponding to a generally uniform shade on the original).

Present commercial apparatus have predominately utilized cascade or magnetic brush systems, incorporating a development electrode in some form to enhance solid area development. The function of the development electrode in these devices is to cause the electric field of the large solid area to be external of the image member (rather than within the member) and thus to more accurately reflect the electrostatic surface charge of the area. This is accomplished in cascade systems by locating an electrically conductive plate opposite the development zone; the plate can be biased to a potential level to control background development. In magnetic brush systems, the metallic cylinder of the brush can be similarly biased to perform as a development electrode.

Numerous variations of such systems have been devised to facilitate increased density and uniformity of large solid areas in high speed development. For example, extended development zones and automatic bias variation (in response to feedback from the electrostatic image) have been utilized to increase density and improve uniformity. However, even with the best of these systems, there remain significant aspects for improvement.

Recently issued U.S. Pat. No. 4,076,857 discloses a new development approach which offers advantage in the attainment of increased image density in high speed operation. This approach, in general, utilizes a partially-conductive developer, as distinguished from most prior art developer mixtures, which can be characterized as substantially insulative. In this new approach, the combination of using such partialy-conductive developers and of applying the developer in controlled conditions which cause an "electrical breakdown" of the developer mixture between the applicator and the image member causes a remarkable increase in the extent of development, i.e., the quantity of toner transferred to the image member.

We have observed that, although partially-conductive developer mixtures offer advantages in the breakdown development mode and other modes of development, certain non-uniformities exist in the development of large solid image areas with such mixtures. Specifically we have noted that certain portions (particularly leading and trailing edge portions) of large solid image areas are developed disproportionately in density (either much too light or much too dark.). These non-uniform development effects can, in some instances, detract significantly from the overall image quality.

SUMMARY OF THE INVENTION

The present invention pertains to the problems outlined above and it is an object of the invention to provide improved electrographic development method and apparatus that have particular advantage in the development of large solid area image portions.

In general this inventive approach involves: (1) moving an electrostatic-image-bearing member past a development zone; (2) transporting successive quantities of partially-conductive developer through transfer relation with the moving member in a direction generally countercurrent to the member's movement and (3) transporting successive quantitites of partially-conductive developer through transfer relation in a direction generally the same as said member's movement. Preferably, these sequential developer transports occur at separate locations and in the presence of an electrical reference potential(s), said countercurrent transport occurs first and at least one of (a) the relative velocity of developer transport at the separate locations and (b) the relative reference potential provided at the separate locations is predeterminedly controlled to balance development and achieve more uniform density throughout large solid area image portions.

BRIEF DESCRIPTION OF THE DRAWINGS

In the subsequent description of preferred embodiments and modes, reference is made to the attached drawings which form a part hereof and in which.

DESCRIPTION OF THE PREFERRED EMBODIMENTS

Figure 2A:
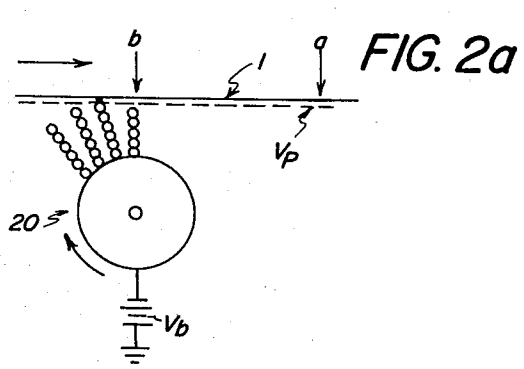
FIGS. 1*a–c* and 2*a–c* are schematic illustrations and diagrams indicating physical effects involved in the present invention.

Before progressing to the description of particularly preferred modes and structures for practice of the present invention, a preliminary discussion of various physical phenomena believed to be occurring in development with partially-conductive developers, will be found useful. For this purpose reference is made to FIGS. 1 and 2 which each schematically illustrate an image member 1, e.g., a conventional photoconductor which has been charged and imagewise exposed, and is moving from left to right across a development station. The development station comprises a magnetic brush development system which is applying a partially-conductive developer mixture to develop a large solid area electrostatic image (in this instance a large block image of the letter H).

At this stage, an understanding of what is meant by a "partially-conductive developer" is important. As used herein that term is intended to describe developer mixtures which exhibit electrical charge passing characteristics that are intermediate those of materials commonly thought of as conductors or insulators. One mode of specifying developer mixtures which fall within the contemplated scope of the term "partially-conductive", is by electrical resistance value in a given test condition. However, the electrical resistance of some developer materials changes from ohmic behavior and drops significantly in the presence of a high electrical field. This electrical breakdown can cause a developer not normally contemplated as partially-conductive to become what is contemplated as partially-conductive. It therefore is useful to alternatively define what is meant by partially-conductive developer in terms of the electrical breakdown characteristic.

Considered from the first viewpoint, developer mixtures are considered herein to be partially-conductive if they have an electrical resistance of less than $10^9$ ohms when measured in the following procedure. Using a cylindrical bar magnet ($\approx$560 Gauss North pole) having a circular end of 6.25 $cm^2$ area, a 15 gram quantity of developer mixture is attracted to said end and, while so supported, disposed about 0.5 cm from a burnished copper plate with the magnet end and plate surface being generally parallel. The resistance of the mixture is then measured between the bar magnet and the copper plate in generally room conditions (approximately 70° F. and 40% relative humidity) using an electrometer, e.g., a General Radio D.C., 1230-A, 6–9 volt or comparable type.

Considered from the viewpoint of electrical breakdown value, a developer mixture in question can be tested in its operating environment, e.g., with the actual state of electrical field, density, relative humidity, etc., in which it is utilized. If, when tested in such conditions, the developer undergoes a sudden drop in electrical resistance, "electrical breakdown" is said to have occurred. Developer mixtures which undergo such "electrical breakdown" can be useful in the present invention and are considered to be "partially-conductive" to the extent they exhibit such an electrical resistance drop in the actually utilized mode of operation. Developers which exhibit breakdown in fields of less than 25 volts per millimeter of developer thickness typically can be partially-conductive. Further discussion and examples of electrical breakdown and of developers which exhibit this characteristic are disclosed in U.S. Pat. No. 4,076,857 which is incorporated herein by reference.

Typical partially-conductive developers will comprise a toner and a carrier. The toner particles are usually relatively insulative. The carrier may be conductive itself, or a conductive additive may be added to the carrier to improve the conductivity of the developer, e.g., as in U.S. Pat. No. 2,919,247. Typical partially-conductive developer compositions include carriers such as iron, cobaltic oxide, stannic oxide, zinc and ferromagnesium, cupric carbonate, zinc carbonate, manganese carbonate, cupric oxide, lead acetate, zirconium, and nickel carbonate. Single component developers can also be partially-conductive.

Referring again to FIGS. 1 and 2, the magnetic brush assemblies 10 and 20 each comprise a rotary cylinder which in some conventional manner magnetically transports iron carrier particles to which electrographic toner is triboelectrically attracted. In these diagrams the electrostatic image is indicated as having a negative polarity so that typically the toner would be charged positively and the magnetic brush biased negatively to control background development, while also serving as a development electrode in the conventional sense.

Figure 1A:
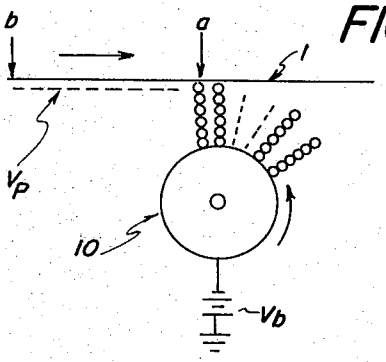
Figure 1B:
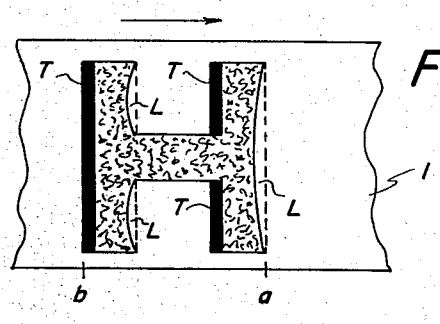
Figure 1C:
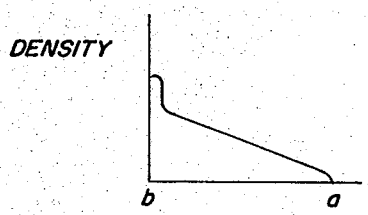

Referring particularly to FIG. 1(*a*), it will be noted that brush 10 is rotated so that developer is moved across the development zone in a direction opposite, or countercurrent, to the direction of movment of the image member 1. After various experiments, we have noted that two identifiable effects repeatedly occur when developing large solid areas with partially-conductive developer in this mode. These are illustrated in simplified form in FIG. 1 (*b*) where it can be noted that zones of depleted development exist along edges L of the block character H. Upon study of the character, it will be realized that the zones L each constitute the leading edge of a large solid area of the electrostatic image on the photoconductor, i.e., the edge first entering the development zone as the photoconductor moves from left to right. A second noted effect, which is illustrated in the diagram, is that zones T of the image are of density exceeding that further within the solid area. Generalizing it will be noted that each area T constitutes a trailing edge of a large solid area portion of the photoconductor, i.e., a portion of its solid area last residing in the development zone as the photoconductor moves from left to right.

After analysis of the phenomena connected with partially-conductive developers, we theorize that these described edge effects are caused by variations in the development field between the surface of the partially-conductive developer and the photoconductor surface. More specificially we theorize that, with partially-conductive developers, the effective development field (between developer surface and the charge-bearing photoconductor surface) increases in proportion to the amount of time which the developer surface exists in the presence of charged photoconductor surface.

In this regard consider a development system such as shown in FIG. 1*a*. As the leading edge of an image first moves into the development zone a like voltage is induced on the surface of the developer because of the capacitance of the developer. This initially induced voltage is of a magnitude which significantly affects the development field and thus limits the extent of development, i.e., toner transfer to the photoconductor. However, over a period of time in the presence of the photoconductor potential, the potential of the developer surface decreases because the partial conductivity of the developer allows charge leakage from the developer surface to the development roller. This decrease in potential of the developer surface increases the operative development field and thus the transfer of toner to the image. The rate of this development field (and thus development) increase is dependent to a large extent on the resistance-capacitance characteristic of the developer, and the developer can be viewed as having an RC time constant that causes an increase in development that is proportional to time in the presence of the photoconductor potential. It should be borne in mind, however, that in instances of developer breakdown such as described in U.S. Pat. No. 4,076,857, the development field increase will be more instantaneous, as some point after the developer is subjected to the photoconductor potential, than such increase would be with partially-conductive developers which do not undergo dielectric breakdown.

Thus the theorized model indicates that, with partially-conductive developer, more toner transfer will occur from developer which has existed for a period of time in the presence of the photoconductor potential than from developer which is newly subjected to the photoconductor potential. Comparing this theorized model to the FIG. 1 development diagrams, it will be seen that the observed results, FIG. 1*b*, are compatible with this theory. That is the leading edges L of block character are developed less than subsequent portions because the induced voltage on the developer surfaces contacting these portions is higher (and the development field therefore less) than on the developer surfaces which contact subsequent portions of the image.

Stated another way, as a leading edge of the large solid area moves into the development zone, the developer which contacts it has not previously resided in any substantial electrical field. Contrarily, the developer which contacts the trailing edges of large solid areas in the FIG. 1(*a*) development mode has had substantially more time in the electrical field between the electrostatic image and development electrode. If the developer does exhibit a time-varying response to the photoconductor potential (i.e., increasing the development field in proportion to time in the influence of such potential), one would expect that the leading edge would be less developed by the unconditioned developer. The trailing edge density would be expected to be greater because the development field of the time-conditioned developer to which it was subjected was proportionately greater. Experiments appear to confirm this analysis beyond the extent shown in FIG. 1(*b*), in that the image density actually appears to increase from leading to trailing edge across the entire large solid area. The more defined "edge effects" illustrated in FIG. 1(*b*) and in practice are more visually evident, being emphasized by fringe fields at image termini. An exemplary "density" versus "position-across-solid-area" curve is shown in the (*c*) portion of FIG. 1.

Figure 2B:
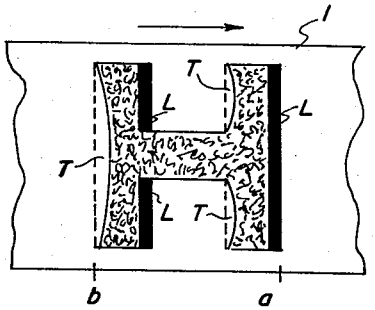
Figure 2C:
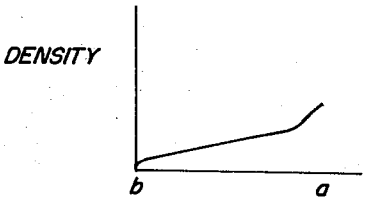

Referring now to FIG. 2(*a*), the development station there illustrated is the same as described with respect to FIG. 1(*a*) except that magnetic brush 20 is rotated so that developer moves through transfer relation with the photoconductor in the same (co-current) direction as the photoconductor. In FIG. 2(*b*) the edge effects noted in this mode of development are illustrated. Thus, it can be seen that the leading edge portions L of large solid areas are densely developed while the trailing edge portions T are weakly developed. We theorize the same physical mechanism to be in effect in this mode. Consider, a leading edge portion in this mode is subjected to developer which has been in the image field for a period which substantially exceeds the field conditioning period afforded the leading edge in the FIG. 1(*a*) mode. Thus additional developer conditioning time increases the effective development field and yields higher density. However, the trailing edge portion of the large solid areas in this mode are developed with developer which has not been in the presence of the electrostatic image and thus the effective development field for developer applied to the trailing edge portion is commensurately smaller. Hence the weakly developed trailing edge. An exemplary "density" verus "position-across-solid-area" curve is shown in the (*c*) portion of FIG. 2.

According to the present invention the phenomena described above can be organized and controlled to significantly enhance solid area development with partially-conductive developer. One structural embodiment for practice of the present invention is disclosed in FIG. 3. The development apparatus 30 there illustrated comprises two magnetic brushes 31, 32 mounted at a development station along the path of an electrographic image member 33. The image member can be of various types known in the art, e.g., including a photoconductive insulator layer 34, an electrically conductive backing layer 35 and a film support 36. Each of magnetic brushes 31, 32 respectively comprises an array of strip magnets, denoted N and S, arranged as shown around the periphery of inner cores 38 and 39, which are stationary within developer reservoir 40. Each brush also includes an electrically conductive outer cylinder 41 and 42 respectively, which is non-magnetic and rotatable around the core to transport developer mixture, attracted by the magnets N and S, from the reservoir 40 into contact with the image member 33 and back into the reservoir to be replenished. To facilitate uniform distribution of developer longtiudinally across the brush surface, augers 48, 49 can be provided in the reservoir as shown. Preferably, the augers have a pitch which varies longtiduinally to equalize the quantity of developer supplied. It is to be noted that the cylinders 41 and 42 of brushes 31 and 32 are rotated in different directions, as indicated, by drive means 43, 44 respectively, and that each cylinder has a separate electrical bias from respective potential sources $Vb_1$ and $Vb_2$.

In operation the image member 33 is moved as shown across the development apparatus as the magnetic brushes 31 and 32 are rotated in the directions described and shown. It will be appreciated that a large solid area on the image member will thus be subjected sequentially to the development effect shown in FIG. 1, then the development effect shown in FIG. 2. The purpose of this approach can be generalized by considering the resulting overall density of an image exiting the development station as directly related to the sum of the individual densities provided by the rollers acting separately, i.e., adding the curves shown in FIGS. 1(*c*) and 2(*c*). We have found that this combination does in fact result in improvement as to edge effects; however, there are other parameters which can be controlled to optimize the resultant development. Thus, the density curve, such as FIG. 1(*c*) and 2(*c*), representing the development by each individual brush acting alone would vary depending upon the speed of rotation and/or the bias applied to the brush. There are also interrelated effects between the two separate brushes, for example the density provided by the second operating brush is less because the electric field due to the photoconductor charge is less after development by the first operating brush. Optimum results can be achieved by controlling one or both of the speed of rotation and bias to obtain approximately equal density for the leading and trailing edge portions of a large solid area. This optimum condition of operation can be fine-tuned empirically for a given system, but the following general criteria have been found to result in preferred modes of operation. First, it is usually necessary that developer transported by the co-current rotating brush have a velocity at least equal to the velocity of the photoconductor surface. Second it is generally preferred that the brush members be rotated so that the relative velocities of their peripheral surfaces with respect to the moving photoconductor do not differ greatly. Given the above criteria and relative brush diameters, generally appropriate rotational rates can be selected for the brushes. For example, with brushes of equal diameter (about 7.62 cm) and with a photoconductor moving at about 25.4 cm/sec we have found desirable peripheral speeds to be about 23.88 cm/sec for the countercurrent brush and 71.88 cm/sec for the co-current brush. The optimum rotational rates will vary with photoconductor speed, developer conductivity and other system parameters, e.g., brush bias.

In selecting appropriate brush bias it is usually preferred that the bias of the downstream brush member (e.g., $Vb_2$ of brush 32 in FIG. 3) be greater than the background potential of the photoconductor image. This minimizes any extraneous background development. A highly preferred mode of operation provides a bias on the upstream brush which is significantly less than the bias on the downstream brush, to provide for as complete development of the electrostatic image as possible. In this regard the bias of the upstream roller could be such as to cause "breakdown" development. In connection with photoconductor and brush speeds as described above and with an electrostatic image having 500 volt image and 125–250 volt background charge, we have found it desirable to bias the upstream roller in the range of 50 to 125 volts and the downstream roller in the range of 125 to 250 volts.

Lastly, it has been found highly preferable to have the last downstream brush rotating in a co-current direction. This provides enhanced results in smoothness of the large solid area images.

It is important to note that highly useful results can be achieved according to the present invention without compliance with all of the foregoing criteria. The essential aspect is that at least one brush be rotated co-current and at least one brush be rotated countercurrent to the direction of the photoconductor and that one or more of the development influencing parameters (i.e., relative brush velocities or biases) be controlled to provide approximately equal density development for leading and trailing edge portions of solid area images.

Figure 3:
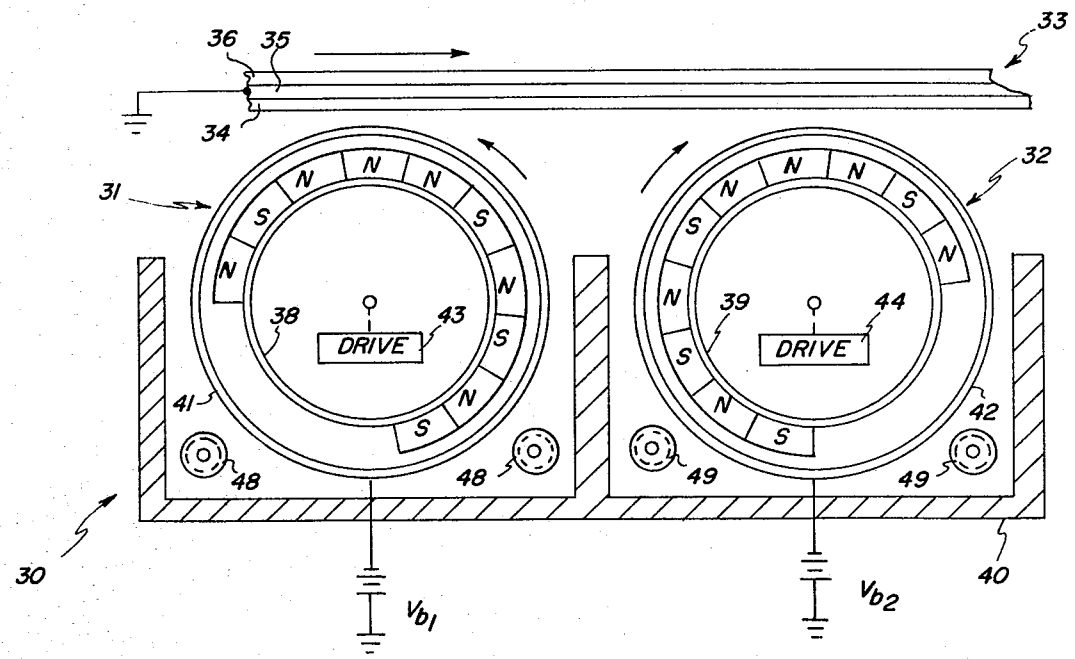
FIG. 3 is a schematic side view of one preferred embodiment of the present invention.

By way of further teaching of typical parameters useful for practice of the present invention, the following more detailed example of a specific development system will be useful. A two-magnetic-brush device constructed generally as shown having outside cylinder diameters of 7.62 cm, was used, and the magnets were elongated strips arranged as shown in FIG. 3. The developer was a mixture of polymer coated iron particles and toner which had a resistance of about $10^8$ ohm when measured by the procedure outlined previously herein. The image member comprised an organic photoconductor overlying a metallized surface of a flexible plastic belt and was moved over the development device in the direction shown in FIG. 3 at a linear velocity of about 25.4 cm/sec. The photoconductor was charged originally to a potential of about −400 volts and imagewise exposed to a pattern having large solid area portions. Background portions of the resultant electrostatic image were discharged by the exposure to a potential of about −100 to =150 volts. The first countercurrently rotating brush was rotated at about 100 RPM and biased to a potential of −80 volts. The second co-currently rotating brush was rotated at about 140 RPM and biased to about −150 volts. The rotating shells of both brushes were spaced about 2.54 mm from the moving photoconductor surface and the brushes were spaced center-to-center about 13 cm. The resultant image developed by this system was smooth and uniform with a maximum density of about 1.2. Solid areas of the image exhibited balanced leading and trailing edge density. Typed characters on the image were clean and possessed high density and fine line development was excellent. Background areas of the image were clean, i.e., did not have extraneous toner thereon.

It will of course be understood that the present invention is not limited to the particular configurations shown in the drawings and described above. For example in certain applications it may be highly useful to have more than two magnetic brush members, with one or more rotating in opposite directions. The brushes need not contact an image member along a linear path but could be disposed around the periphery of an image drum. The particular magnetic brush construction is not critical; as is known in the art such members can take many forms for example with stationary outer cylinders and rotating magnets or with various other known modifications. Beyond this the present invention may be utilized with other development systems than magnetic brush, provided suitable application means are provided to transport developer through separate portions of the development zone in co-current and countercurrent directions. Separate cascade systems may be envisioned for this purpose or combinations of cascade or other application systems with magnetic brush development can be utilized.

Although the preferred embodiment for practice of the invention provides separate development stations, lower speed implementation of the invention could utilize a single applicator which sequentially applies developer to the moving image member in the defined manner. For example, a translating image member could be moved across a rotating brush, first in one direction and then in the opposite direction. Or, the brush could be translated to provide equivalent results. Similarly, the image member could make sequential passes in the same direction with the direction of brush rotation reversed to provide the desired development. Other variations may occur to those skilled in the art.

The invention has been described in detail with particular reference to certain preferred embodiments thereof, but it will be understood that variations and modifications can be effected within the spirit and scope of the invention.

We claim:

1. In electrographic apparatus of the type constructed to move an electrostatic-image-bearing member in a first direction through a development zone at a predetermined absolute velocity, an improved developing device comprising:

(a) first applicator means for transporting successive quantities of partially-conductive developer, at a predetermined transport rate, through one portion of said development zone in transfer relation with said member and in a direction generally opposite said first direction;

(b) second applicator means for transporting successive quantities of partially-conductive developer, at a predetermined transport rate, through another portion of said development zone in transfer relation with said member and in a direction generally the same as said first direction; and (c) electrode means spaced opposite said development zone for electrically coupling each of such quantities of developer to reference potential while in transfer relation with said member;

at least one of: (1) the relative transport rate of said first and second applicator means and (2) the reference potential of said electrode means, being predeterminedly constructed to balance development of leading and trailing edge portions of solid-area electrostatic images.

2. The invention defined in claim 1 wherein said first and second applicator means are respectively constructed to provide developer transport at first and second absolute velocities, the second absolute velocity of developer transport of said second applicator means being at least equal to the predetermined absolute velocity of said member through said development zone and the first absolute velocity of developer transport of said first applicator being predeterminedly less than that of said second applicator means so as to balance the development of such leading and trailing edge portions.

3. The invention defined in claim 2 wherein said electrode means is constructed to provide separate reference potentials respectively to developer applied by said first and second applicator means, such reference potentials being of predeterminedly different magnitude so as to further balance development of said leading and trailing edge portions.

4. The invention defined in claim 3 wherein said second applicator means is located downstream in the direction of photoconductor movement from said first applicator means.

5. The invention defined in claim 4 wherein said electrode means is constructed so that the reference potential provided to developer transported by said second applicator means is at least equal to the potential of background areas of electrostatic images on said member and the reference potential provided to said first applicator means is substantially less than that provided to developer transported by said second applicator means.

6. The invention defined in claim 1 wherein said second applicator means is located downstream in the direction of photoconductor movement from said first applicator means.

7. The invention defined in claim 1 wherein said electrode means is constructed to provide separate reference potentials respectively to developer applied by said first and second applicator means, such reference potentials being of predeterminedly different magnitude so as to balance development of said leading and trailing edge portions.

8. In electrographic apparatus of the type adapted for moving an electrostatic-image-bearing member in a downstream direction across a development zone for development with a partially-conductive developer including electrographic toner, an improved development device comprising:

(a) first and second developer applicators spaced along said development zone, each having a peripheral surface for transporting successive quantitites of developer from a supply into transfer relation with such member;

(b) means for actuating said first applicator means to transport developer through such transfer relation at a first absolute velocity and in a direction generally opposite said downstream direction; and (c) means for actuating said second applicator means to transport developer through such transfer relation in generally said downstream direction and at a second absolute velocity, which differs from said first absolute velocity;

the first and second absolute velocities, effected by said respective actuating means, being predeterminedly balanced so that the density throughout developed solid-area image portions on said member are substantially uniform.

9. The invention defined in claim 8 wherein said actuating means are constructed so that the absolute velocity of developer transported by said first applicator means is less than the absolute velocity of developer transported by said second applicator means by a magnitude which approximately balances development throughout such solid-area image portions.

10. The invention defined in claim 9 wherein said second applicator means is located in the downstream direction from first applicator means.

11. The invention defined in claim 10 further including means for providing an electrical reference potential, at least equal to the background potential on said electrostatic-image-bearing member, to developer applied to said second applicator means and means for providing a substantially lower electrical reference potential to developer applied by said first applicator means.

12. The invention defined in claim 8 wherein said first and second applicator means each comprise at least one magnetic brush.

13. The invention defined in claim 8 wherein said developer comprises a triboelectric mixture of carrier particles and toner particles having a resistance not greater than $10^9$ ohms.

14. In electrographic apparatus of the type in which an electrostatic-image-bearing member is moved across a development zone, in a downstream direction, for development by a partially-conductive developer containing electrographic toner, an improved electrographic development device comprising:

(a) first and second magnetic brush means for respectively transporting such developer from a supply into transfer relation with such member at successive first and second portions of said development zone;

(b) first means for operating said first magnetic brush means so that successive quantities of developer transported thereby move through such transfer relation in a direction generally opposite said downstream direction at a first absolute velocity;

(c) second means for operating said second magnetic brush means so that successive quantities of developer transported thereby move through such transfer relation in generally said downstream direction at a second absolute velocity which is different from said first absolute velocity;

(d) first and second electrode means respectively for providing first and second reference potentials to developer moved through said first and second portions of said development zone; and (e) means for controlling the rate of developer transport effected by said first and second operating means and the reference potential provided by said first and second electrode means so that the development of a solid-area image passing through said development zone is substantially uniform throughout.

15. The invention defined in claim 14 wherein said first absolute velocity is substantially less than said second absolute velocity.

16. The invention defined in claim 15 wherein the reference potential at said second zone portion is substantially higher than the reference potential at said first zone portion.

17. The invention defined in claim 14 wherein said developer comprises a triboelectric mixture of carrier particles and toner particles having a resistance of less than $10^9$ ohms.

* * * * *